US010266311B2

(12) United States Patent
Rognard

(10) Patent No.: US 10,266,311 B2
(45) Date of Patent: Apr. 23, 2019

(54) CLOSURE

(71) Applicant: Obrist Closures Switzerland GmbH, Reinach (CH)

(72) Inventor: Jean-Yves Rognard, Marcy-sur-Anse (FR)

(73) Assignee: Obrist Closures Switzerland GmbH, Reinach (CH)

( * ) Notice: Subject to any disclaimer, the term of this patent is extended or adjusted under 35 U.S.C. 154(b) by 0 days.

(21) Appl. No.: 15/578,947

(22) PCT Filed: May 28, 2016

(86) PCT No.: PCT/EP2016/062095

§ 371 (c)(1),
(2) Date: Dec. 1, 2017

(87) PCT Pub. No.: WO2016/193182

PCT Pub. Date: Dec. 8, 2016

(65) Prior Publication Data

US 2018/0170628 A1 Jun. 21, 2018

(30) Foreign Application Priority Data

Jun. 1, 2015 (GB) ..... 1509390.9

(51) Int. Cl.
*B65D 41/34* (2006.01)
*B65D 47/08* (2006.01)

(52) U.S. Cl.
CPC ..... *B65D 41/3457* (2013.01); *B65D 47/0804* (2013.01); *B65D 47/0838* (2013.01);
(Continued)

(58) Field of Classification Search
CPC ..... B65D 41/32–41/3457; B65D 47/04–47/0838; B65D 2101/0046; B65D 2101/0069
(Continued)

(56) References Cited

U.S. PATENT DOCUMENTS 8,733,566 B2 * 5/2014 Druitt ..... B65D 47/0809 215/237
8,794,460 B2 * 8/2014 Druitt ..... B65D 47/0809 215/235
(Continued)

FOREIGN PATENT DOCUMENTS

EP 1892194 A1 2/2008
GB 2442227 A 4/2008
(Continued)

OTHER PUBLICATIONS

Aug. 5, 2016—(WO) International Search Report and Written Opinion—App PCT/EP2016/062095.
Jun. 23, 2015—(GB) Search Report—App 1509390.9.

*Primary Examiner* — Kareen K Thomas
(74) *Attorney, Agent, or Firm* — Banner & Witcoff, Ltd.

(57) ABSTRACT

A flip-top dispensing closure is provided and comprises a base connectable to a container neck and a lid connected to the base by a hinge so as to be movable between a closed position and an open position. The closure comprises a tamper-evident drop band irreversibly moved from a first position to a second position to indicate if the lid has been opened. The lid comprises retention means for non-frangibly holding the band in the first position in an initial closed position, and as the lid is moved towards the open position the band is released from the retention means and moves to the second position.

20 Claims, 4 Drawing Sheets

(52) U.S. Cl.
CPC ..... *B65D 2101/0046* (2013.01); *B65D 2101/0069* (2013.01)

(58) Field of Classification Search
USPC ..... 215/258, 901, 201–225, 316, 272, 277, 215/328, 333, 336, 337, 338, 339, 340
See application file for complete search history.

(56) References Cited

U.S. PATENT DOCUMENTS

| | | | | |
|---|---|---|---|---|
| 2011/0056904 | A1 | 3/2011 | Rozenberg | |
| 2014/0138274 | A1 | 5/2014 | Smith et al. | |
| 2015/0375908 | A1* | 12/2015 | Rognard | B65D 47/0828 215/235 |
| 2016/0244219 | A1* | 8/2016 | Benoit-Gonin | B65D 47/0804 |
| 2017/0050773 | A1* | 2/2017 | Rognard | B65D 41/3428 |
| 2017/0240326 | A1* | 8/2017 | Rognard | B65D 47/0809 |

FOREIGN PATENT DOCUMENTS

| | | | |
|---|---|---|---|
| WO | 2004067387 | A2 | 8/2004 |
| WO | 2015049066 | A1 | 4/2015 |

* cited by examiner

CLOSURE

CROSS-REFERENCE TO RELATED APPLICATIONS

The present application is a U.S. National Phase of International Application No. PCT/EP2016/062095, filed on May 28, 2016, designating the United States of America, and claims priority to British Patent Application No. 1509390.9, filed Jun. 1, 2015. This application claims priority to and the benefit of the above-identified applications, each of which is fully incorporated by reference herein.

The present invention relates generally to a closure and particularly, although not exclusively, to a container closure including one or more tamper-indicating features.

There is a widespread requirement within the field of closures for mechanisms which can be used to indicate to a consumer if a closure is unopened. One very common system uses a drop band which is frangibly connected to the open end of a closure base and which drops onto and remains on a container neck if the closure base is removed. There are also frangible mechanisms for indicating if two parts of a closure have been separated, for example, if a lid has been removed from a base.

The present invention seeks to provide improvements over known tamper-indicating closures.

According to the present invention there is provided a flip-top dispensing closure comprising a base connectable to a container neck and a lid connected to the base by a hinge so as to be movable between a closed position and an open position, the closure comprising a tamper-evident drop band irreversibly moved from a first position to a second position to indicate if the lid has been opened, the lid comprising retention means for non-frangibly holding the band in the first position in an initial closed position, and as the lid is moved towards the open position the band is released from the retention means and moves to the second position.

The base may cause the band to be released from the lid as it moves away from the initial closed position. For example the base may restrain the band as the lid is opened so that it is caused to be released from the lid (e.g. pulled away from the lid).

The band may be generally annular.

The band may be a unitary structure. For example the band may be a one-piece moulded structure. The band itself may be unaffected by movement from the first to the second position i.e. it is not broken or deformed but simply moves.

The band may comprise one or more flaps for non-frangibly engaging the lid retention means. The flap/s may be inclined radially inwards so that they can grip onto a bead or the like on the lid. This would then allow the band to be non-frangibly pulled away from the lid i.e. it is not broken away from the lid.

The retention means may comprise an annular bead. The bead may, for example, be formed on a skirt or the like on the lid, such as an internal depending skirt. The bead may be formed at or in the region of a free end of a skirt or the like.

The band may be located in the interior of the closure. For example the band may be carried in the interior of the lid and then be transferred to the interior of the base.

The holding means may help to prevent the band from returning to the first position. For example, if the holding means is a bead on the lid the band may be pulled over the bead as the lid is opened but then cannot pass back over the bead (for example if the closure is inverted).

The lid may include a window in which or through which the band is visible in the first position and out of which the band falls as it moves to the second position.

The base may include a void or pocket into which the band drops. This means that the band is not released from the closure but remains captive in the base once the closure is first opened.

The closure may comprise a dispensing member.

The dispensing member may be formed separately from the base and the lid. Alternatively the dispensing member may be formed integrally with the base.

The dispensing member may comprise a spout, such as a drinking spout. The spout member may be fitted into the bore of a container neck in use.

The present invention also provides a closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims.

The present invention will now be more particularly described, by way of example, with reference to the accompanying drawings, in which.

Figure 1B:
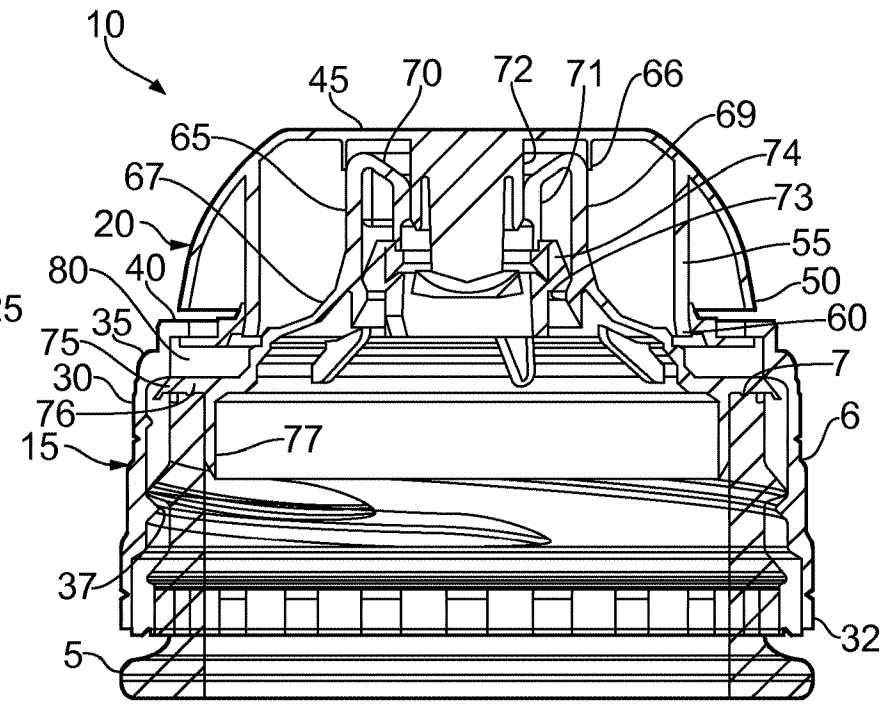
FIG. 1B is a section of the closure of FIG. 1A taken along line A-A.

The example embodiments are described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiment can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

Referring now to the drawings, wherein like reference numbers are used to designate like elements throughout the various views, several embodiments of the present invention are further described. The figures are not necessary drawn to scale, and in some instances the drawings may have been exaggerated or simplified for illustrative purposes only. One of ordinary skill in the art will appreciate the many possible applications and variations of the present invention based on the following examples of possible embodiments of the present invention.

Figure 1A:
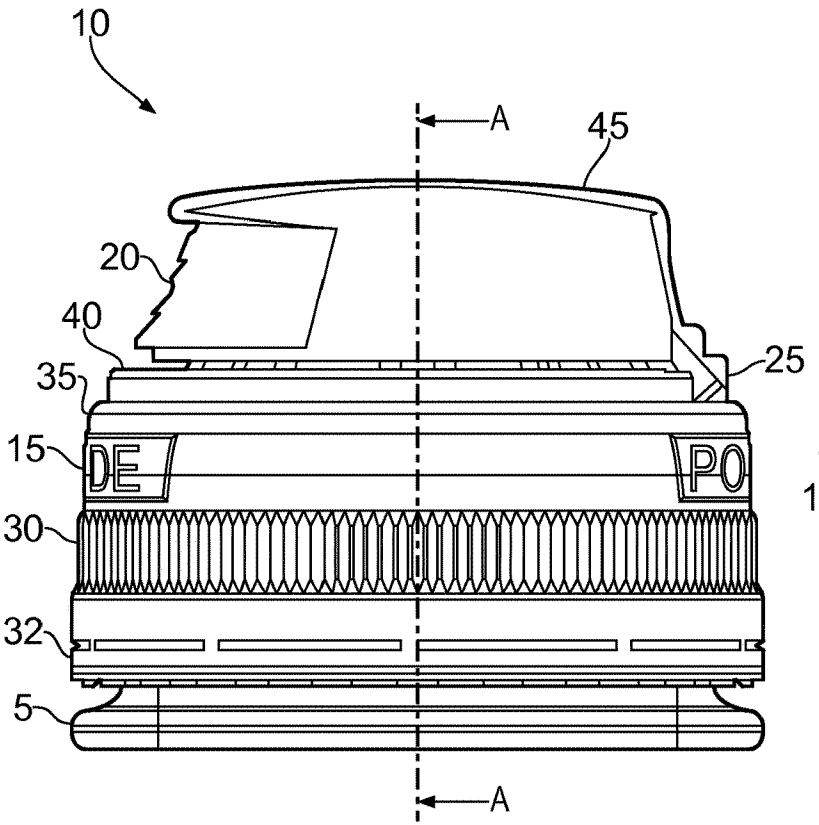
FIG. 1A is a side view of a closure formed in accordance with the present invention and shown in an unopened condition.

FIGS. 1A and 1B show a flip-top closure generally indicated 10 fitted onto a container neck 5. The closure 10 comprises a base 15 and a lid 20 which are connected to each other by a hinge 25.

The base 15 comprises a generally cylindrical sidewall 30 open at both ends. At one end of the sidewall 30 a tamper-evident drop band 32 is frangibly connected. The band 35 is used to indicate if the closure is removed from the container neck one fitted. At the other end of the sidewall 30 a shoulder 35 is provided which merges into a radially inwardly extending flange 40.

The interior of the sidewall 30 is provided with an internal screw thread 37 for engaging a corresponding external screw thread 6 on the neck 5.

The lid 20 comprises a top plate 45. A curved outer sidewall 50 depends from the periphery of the plate 45. A generally cylindrical annular skirt 55 depends from the sidewall 50. The free end of the skirt 55 extends axially slightly beyond the free end of the sidewall (radially inwardly thereof) and is provided with an annular retention bead 60. A gap G is formed between the free end of the skirt 55 and the flange 40.

In this embodiment the closure 10 is further provided with a dispensing spout member 65. The spout member 65 comprises a generally cylindrical drinking spout 66, an intermediate generally frustoconical portion 67 and a base portion 75.

The spout member 65 comprises a generally cylindrical sidewall 69. At the end of the spout sidewall opposite the intermediate portion an inclined annular orifice wall 70 extends inwards and from it an axial annular wall 71 depends; the wall 71 defines an orifice 72. In the closed position a lid spigot 21, which depends from the top plate 45 enters through the wall 71 to close the orifice 72. The end of the wall 69 opposite the orifice is provided with a radially inwardly projecting annular bead 73 which retains a self-closing valve 74.

The base portion 75 comprises a radial annular flange 76 with an annular seal 77 depending therefrom. In use, the seal 77 enters the bore of the container neck such that it seals against its inner surface, and the flange 76 fits onto the container neck rim 7.

It will be noted that a void or pocket 80 is formed between the spout flange 76 and the shoulder 35/flange 40 of the base.

Figure 5B:
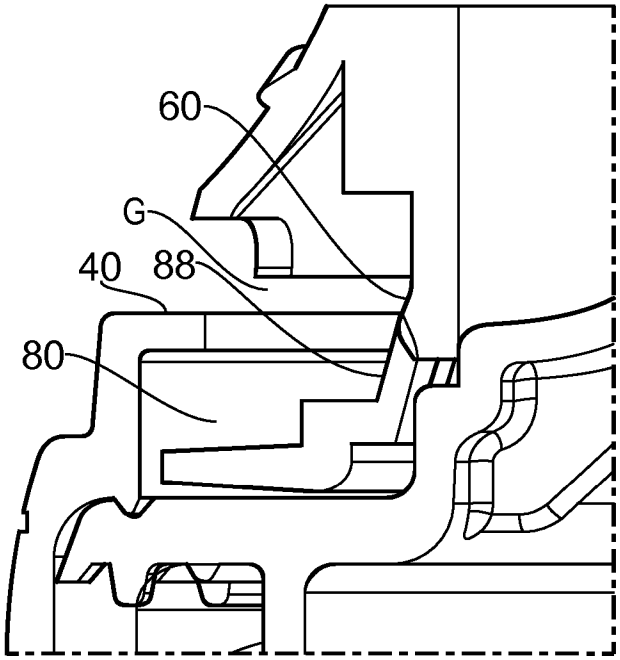
FIGS. 5A and 5B show schematically how a tamper-evident band forming part of the closure of FIGS. 1 to 4 moves to indicate opening.
Figure 5A:
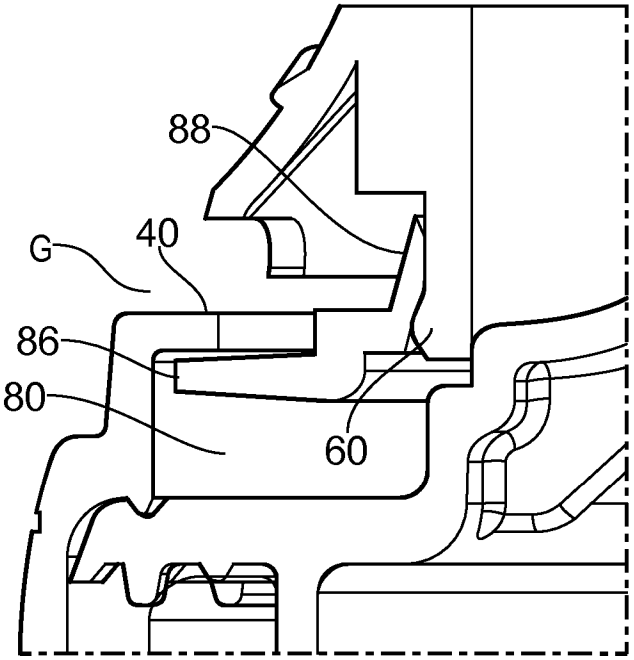
Figure 6:
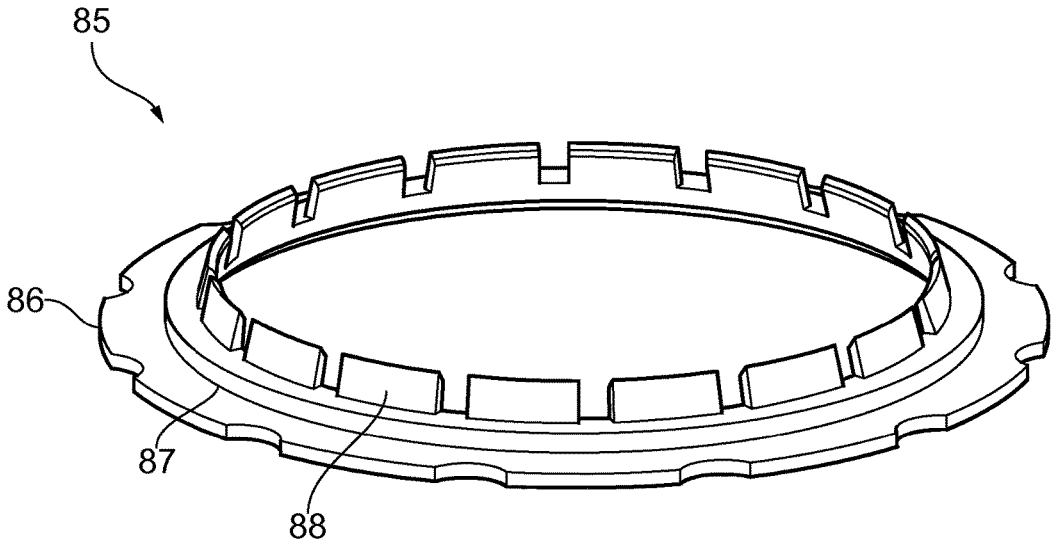
FIG. 6 is a perspective view of a tamper-evident band of FIG. 5.

As shown best in FIGS. 5 and 6, the closure 10 further comprises a tamper-evident drop band 85. The band 85 comprises a radial annular flange 86. An annular step 87 is upstanding from and extends around the inner periphery of the flange 86. At the centre of the step 87 a plurality of circumferentially spaced inclined flaps 88 extend radially inwardly.

FIG. 5A shows the band 85 fitted into the closure. The flaps 88 fit over the bead 60 and the flange 86 is located under the flange 40.

If the lid 20 is opened axial movement of the band 85 is resisted by the inter-engagement of the flanges 40, 86 which causes the flaps to be pulled over the bead 60 as shown in FIG. 5B.

It will be noted that in the unopened position shown in FIG. 5A the flaps 88 are visible through the gap G, whereas when the band 85 drops down into the void 80 the flaps 88 are no longer visible so as to indicate the closure has been opened.

Figure 2A:
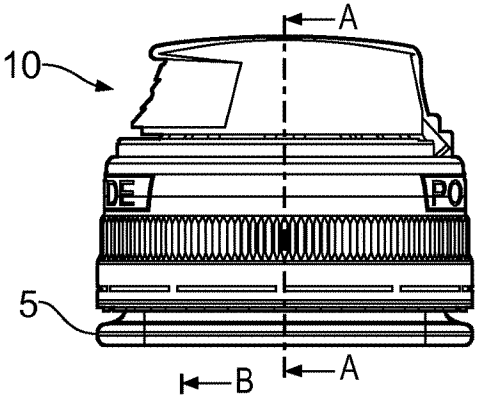
FIGS. 2 to 4 is a sequence showing the closure of FIG. 1 as it moves from an unopened condition, through an opened condition and back to a closed condition.
Figure 2B:
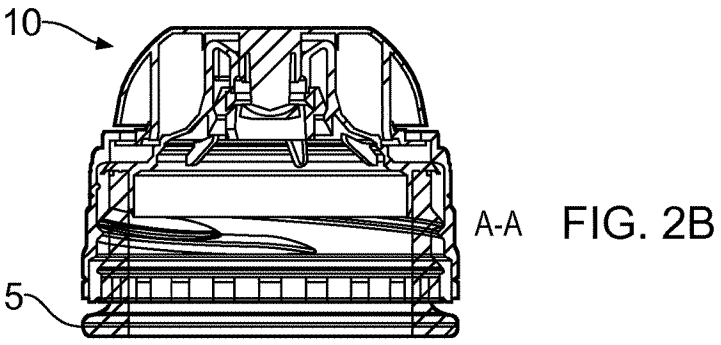
Figure 3A:
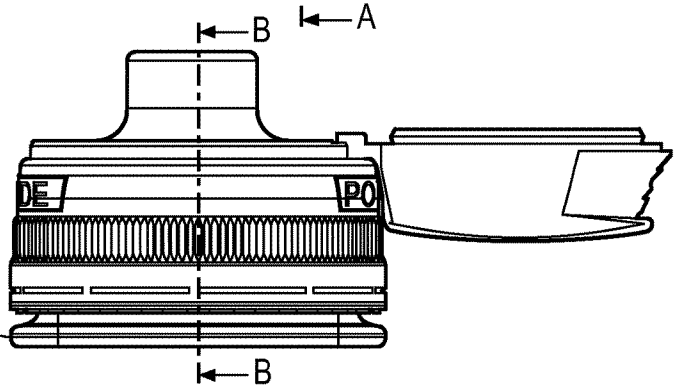
Figure 3B:
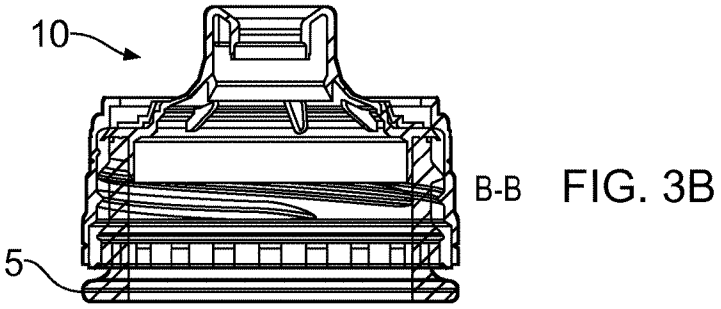
Figure 4A:
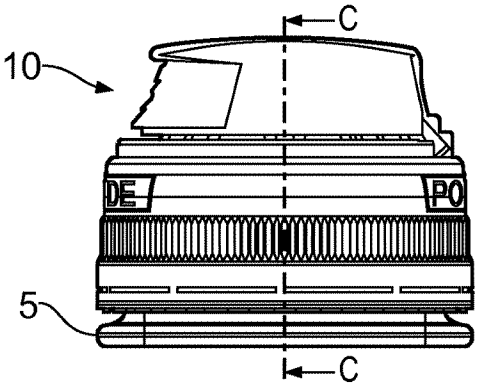
Figure 4B:
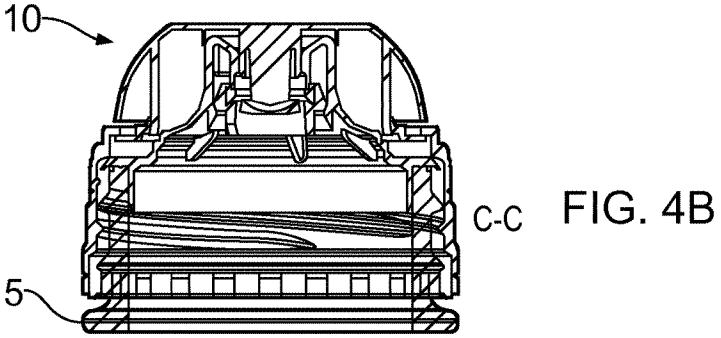

FIGS. 2 to 4 are a sequence of drawings illustrating the closure 10 in an unopened position (FIGS. 2A and 2B), an open position (FIGS. 3A and 3B) and a reclosed position (FIGS. 4A and 4B).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention.

The invention claimed is:

1. A flip-top dispensing closure comprising a base connectable to a container neck and a lid connected to the base by a hinge so as to be movable between a closed position and an open position, the closure comprising a tamper-evident drop band irreversibly moved from a first position to a second position to indicate if the lid has been opened, wherein the band comprises one or more flaps extending radially inwardly, the lid comprising retention means for non-frangibly holding the band in the first position in an initial closed position, and as the lid is moved towards the open position the band is released from the retention means and moves to the second position.

2. The closure as claimed in claim 1, in which the base causes the band to be released from the lid as it moves away from the initial closed position.

3. The closure as claimed in claim 1, in which the band is generally annular.

4. The closure as claimed in claim 1, in which the band is a unitary structure.

5. The closure as claimed in claim 1, in which the one or more flaps are configured to non-frangibly engage the lid retention means.

6. The closure as claimed in claim 1, in which the retention means comprise an annular bead.

7. The closure as claimed in claim 1, in which the band is located in the interior of the closure.

8. The closure as claimed in claim 1, in which the holding means help to prevent the band from returning to the first position.

9. The closure as claimed in claim 1, in which the lid includes a window in which or through which the band is visible in the first position and out of which the band falls as it moves to the second position.

10. The closure as claimed in claim 1, in which the base includes a void or pocket into which the band drops.

11. The closure as claimed in claim 1, in which the closure comprises a dispensing member.

12. The closure as claimed in claim 11, in which the dispensing member is formed separately from the base and the lid.

13. The closure as claimed in claim 11, in which the dispensing member is formed integrally with the base.

14. The closure as claimed in any of claim 11, in which the dispensing member comprises a spout.

15. The closure as claimed in claim 1, in which the lid includes a depending skirt and the skirt is provided with the retention means.

16. The closure as claimed in claim 1 in combination with a container.

17. The closure as claimed in claim 1, in which the base includes a flange for causing the band to be released from the retention means.

18. The closure as claimed in claim 1, in which the one or more flaps are circumferentially spaced and inclined.

19. A flip-top dispensing closure comprising a base connectable to a container neck, a lid connected to the base by a hinge so as to be movable between a closed position and an open position, and a dispensing spout, the closure comprising a tamper-evident drop band irreversibly moved from a first position to a second position to indicate if the lid has been opened, the lid comprising retention means and the band comprising means for gripping the retention means, wherein said means for gripping comprise a plurality of circumferentially spaced flaps extending radially inwards, and holding the band in the first position in an initial closed position in the absence of a frangible connection, whereby as the lid is moved towards the open position the band is released from the retention means and moves to the second position.

20. The closure as claimed in claim 19, wherein said flaps are inclined.

* * * * *